US007029231B2

(12) United States Patent
Hofseth

(10) Patent No.: US 7,029,231 B2
(45) Date of Patent: Apr. 18, 2006

(54) LIQUID SEAL PUMP OF THE HELICAL SCREW TYPE

(75) Inventor: Olav Hofseth, Ulsteinvik (NO)

(73) Assignee: Jets AS, Hareid (NO)

( * ) Notice: Subject to any disclaimer, the term of this patent is extended or adjusted under 35 U.S.C. 154(b) by 120 days.

(21) Appl. No.: 10/478,542

(22) PCT Filed: May 29, 2002

(86) PCT No.: PCT/NO02/00188

§ 371 (c)(1),
(2), (4) Date: May 7, 2004

(87) PCT Pub. No.: WO02/097275

PCT Pub. Date: Dec. 5, 2002

(65) Prior Publication Data

US 2004/0184911 A1 Sep. 23, 2004

(30) Foreign Application Priority Data

May 29, 2001 (NO) ..... 20012641

(51) Int. Cl.
*F04D 3/02* (2006.01)

(52) U.S. Cl. ..... 415/72; 415/111

(58) Field of Classification Search ..... 415/111, 415/112, 72

See application file for complete search history.

(56) References Cited

U.S. PATENT DOCUMENTS 3,265,293 A * 8/1966 Benedictus ..... 418/1
3,575,539 A * 4/1971 Hanick ..... 418/99

FOREIGN PATENT DOCUMENTS

EP 287350 A2 * 10/1988

* cited by examiner

*Primary Examiner*—Ninh H. Nguyen
(74) *Attorney, Agent, or Firm*—Friedrich Kueffner

(57) ABSTRACT

Liquid seal pump of the helical screw type including a pump housing (3) with an inlet (2), an outlet (6), and within the housing provided a helical screw rotor (7) driven by means of a motor (8). The outlet (6) of the pump (3) is provided with a sealing liquid tank (4) for supplying of liquid to the pump and thereby maintaining the liquid seal under idle running of the pump.

6 Claims, 2 Drawing Sheets

LIQUID SEAL PUMP OF THE HELICAL SCREW TYPE

The present invention relates to a liquid seal pump of the helical screw type including a pump housing with an inlet, an outlet and within the housing provided helical screw rotor driven by means of a motor.

Pumps of the above-mentioned type are widely used in vacuum sewage systems being directly connected with the sewage collecting pipe from the toilets and showers etc. The pump is based on the principle of creation of a liquid seal between the rotor and pump housing when the pump is running to obtain the required suction delivery head. With the known type of pumps, under idle running of the pump, a separate supply of liquid to the pump seal is provided through a supply pipe line connected directly to the pump housing, usually prior to the rotor. The liquid may be fresh water from a fresh water supply or black water from a sewage collecting tank. There are, however, several disadvantages of using a separate supply of water to maintain the liquid seal. Using fresh water is as such expensive in most parts of the world. Further, by using a continuous supply of fresh water, more liquid is generated and needs to be getting rid of. In particular in vacuum sewage systems where the storage capacity is limited, for instance on board ships, such extra liquid from the seal deprive storage capacity.

By using black water for the liquid seal, i.e. by pumping black water from the storage tank, no extra liquid is added. On the other hand, using black water has through extensive use shown that the supply pipe line very often becomes clogged due to particles in the black water, which in turn has led to fatal pump damage.

With the present solution is provided a liquid seal pump where the above disadvantages are avoided.

The pump according to the invention is characterised in that the outlet of the pump is provided with a sealing liquid tank for the supply of liquid to the pump and thereby maintaining the liquid seal under idle running of the pump.

The invention will be further described in the following by way of examples only and with reference to the drawings where:

Figure 1:
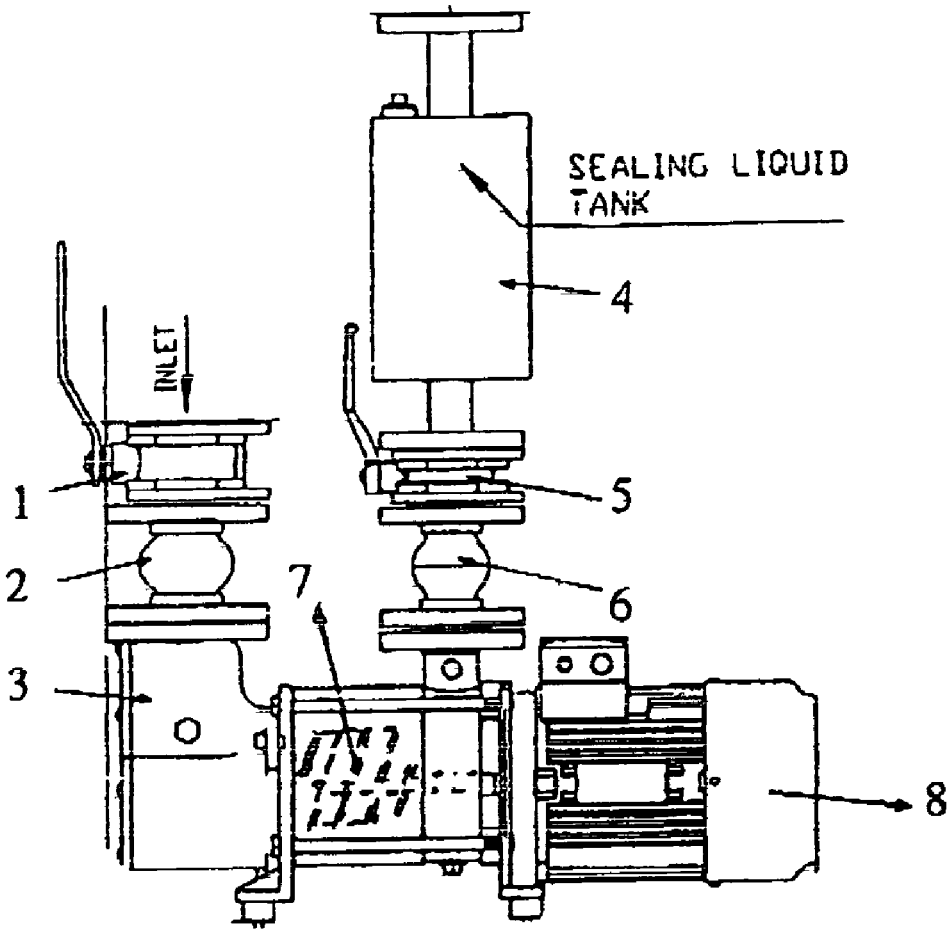
FIG. 1 shows a side view of the pump according to the invention.

The pump according to the invention is as stated above and as shown in FIG. 1 a liquid seal pump of the screw type including a housing 3 with an inlet 2 and outlet 6, and a helical screw 7 provided within the housing 3 which is driven by means of preferably an electrical motor 8. Between the screw and the rotor is gap which, when the pump is running, is filled with liquid circumferentially creating a seal between the inlet and outlet ends (upstream and downstream ends) of the pump. This seal has given the name to the pump, namely "liquid seal pump", and enables a pressure difference between the two ends of the pump. Valves 1 and 5 are provided at the inlet, respectively outlet ends of the pump to enable shutting off of the pump in connection with maintenance and emergency, or when disconnecting it from the pipes to which it normally is connected (se FIG. 2). At the outlet end of the pump is connected a sealing liquid tank 4 supplying liquid to the pump under its idle running. Under normal running when the pump sucks and pumps liquids and air (fluids), the seal liquid tank will be partly or wholly filled up with liquid. When in turn the pump runs idle, the liquid in the tank flows back to the pump, maintaining the liquid seal. Tests have proven that the pump may run for hours without any further supply of liquid form other liquid sources, and temperatures in the pump housing and bearings are kept very low. Further, tests have shown that the volume of the seal liquid tank should be at least twice the volume of the pump housing and the diameter of the outlet in millimeter should essentially correspond to the capacity of in cubic meters per minute. Still further, tests have shown that the volume of the tank 4 should be at least 0.3 liter per cubic meter fluid capacity of the pump at atmospheric pressure.

The pump may be formed as being a part of, or integrated pan of, the outlet pipe of the pump, and the vertical part of the outlet pipe or tank should be at 0.5 meters, adapted to the above volume and capacity measures.

Figure 2:
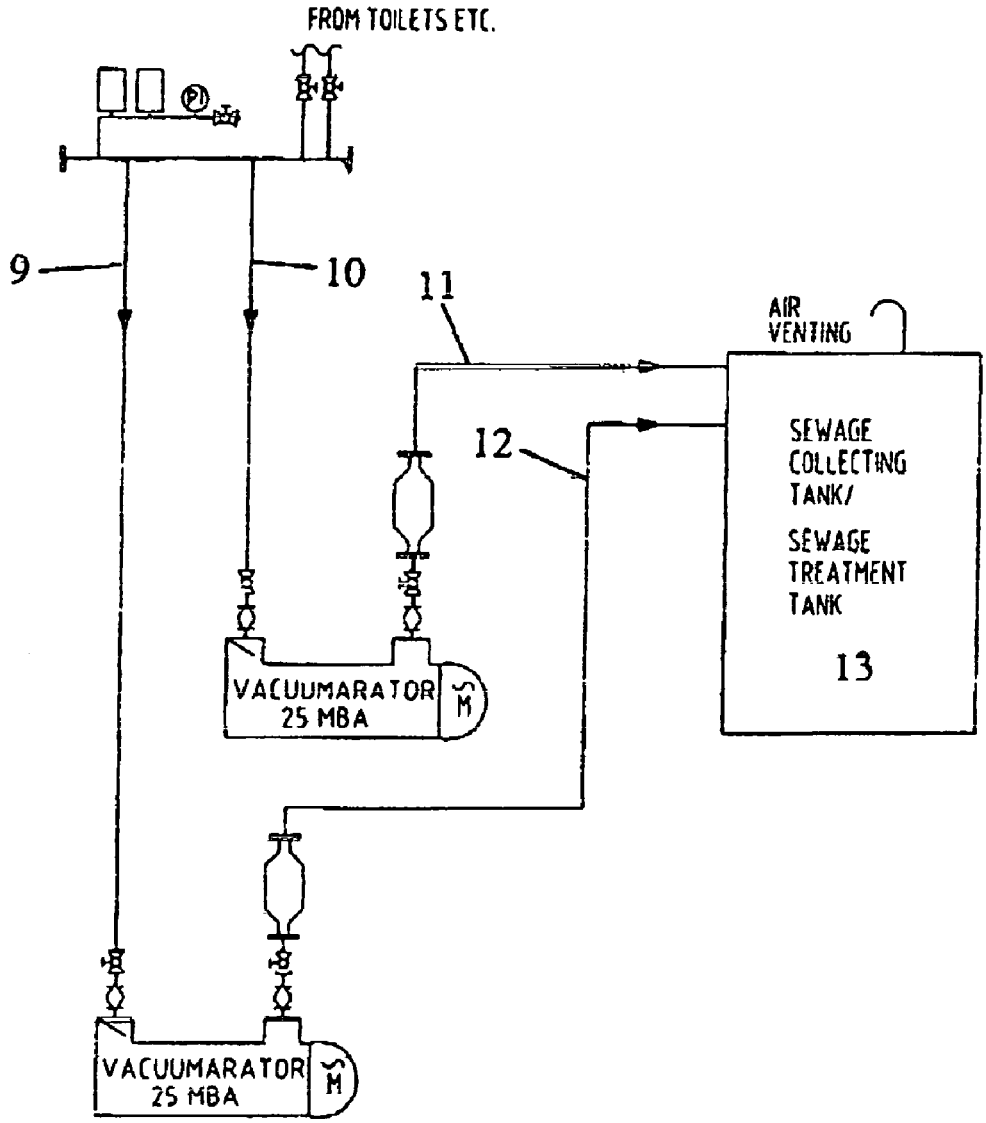
FIG. 2 shows a schematic view of a vacuum sewage system where two pumps according to the invention are provided.

FIG. 2 shows schematically a vacuum sewage system where two pumps 3 according to the invention with seal liquid tanks 4 are provided. Sewage is drawn via pipes 9, 10 from toilets etc. and is pumped to a sewage collecting or treatment tank 13 via pipes 11, 12 respectively. In particular, the present invention is designed to be used in vacuum drainage systems where the pump(s) may run idle for several hours.

What is claimed is:

1. Liquid seal pump of the helical screw type, for use in vacuum drainage systems and with long time idle running of the pump, including a pump housing (3) with an inlet (2), outlet (6) and within the housing provided helical screw rotor (7) driven by means of a motor (8) wherein the outlet (6) of the pump (3) is provided with a sealing liquid tank (4) for the supply of liquid to the pump and thereby maintaining the liquid seal under the idle running of the pump.

2. Liquid seal pump according to claim 1, wherein the volume of the liquid sealing tank (4) is at least twice the volume of the inner space of the pump housing (3).

3. Liquid seal pump according to claim 1, wherein the volume of the tank (4) is at least 0.3 liters per liter fluid capacity of the pump at atmospheric pressure.

4. Liquid seal pump according to claim 1, wherein diameter of the outlet (6) of the pump in millimeters corresponds essentially to the capacity of the pump in cubic meters.

5. Liquid seal pump according to claim 1, wherein the vertical height of the tank is at least 0.5 meter.

6. Liquid seal pump according to claim 1, wherein the liquid seal tank (4) forms part of, or an integrated part of the outlet pipe of the pump.

* * * * *